United States Patent [19]

Hatch et al.

[11] Patent Number: 4,792,099

[45] Date of Patent: Dec. 20, 1988

[54] PULVERIZER AUXILIARY LUBRICATION SYSTEM

[75] Inventors: Edward A. Hatch, Granby; Clemens J. Skalka, Simsbury, both of Conn.

[73] Assignee: Combustion Engineering, Inc., Windsor, Conn.

[21] Appl. No.: 43,786

[22] Filed: Apr. 29, 1987

[51] Int. Cl.[4] ..... B02C 15/04; B02C 25/00

[52] U.S. Cl. ..... 241/30; 184/6.14; 184/26; 241/33; 241/101.2; 241/121

[58] Field of Search ..... 241/117-121, 241/101.2, 30, 33; 184/6.14, 26, 7.4, 27.1, 108, 104.1

[56] References Cited

U.S. PATENT DOCUMENTS 3,465,971 9/1969 Dalenberg et al. ..... 241/119 X

*Primary Examiner*—Mark Rosenbaum

*Attorney, Agent, or Firm*—Arthur E. Fournier, Jr.

[57] ABSTRACT

A pulverizer auxiliary lubrication system (12) particularly suited for use with a pulverizer bowl mill (10) of the type that is operative for effecting the grinding of material. The subject auxiliary lubrication system (12) is designed to be employed to supplement the pulverizer bowl mill's (10) existing lubrication system (48) whereby the beneficial features of the latter are retained while the disadvantages thereof are eliminated. To this end, the subject auxiliary lubrication system (12) includes an oil pump (72), an electric motor (74) coupled (76) to and operative for driving the oil pump (72), one or more filters (78), a pressure relief valve (80), connecting piping (82, 84, 86, 88), gauges (68, 94, 96) and controls (90, 92, 98, 100, 110), and means to supply oil to (86, 88) and draw oil from (82, 84) the pulverizer bowl mill (10). The benefits to be derived from the employment of the subject auxiliary lubrication system (12) are, among others, that the lubricating oil is filtered to remove contaminants which have a deleterious impact on bearing (56, 70) and gear (52) operating life; the flow of oil to the upper shaft bearing (56) of the pulverizer bowl mill (10) is higher than that attainable with the existing integral pump (58) of prior art forms of pulverizer bowl mill lubrication systems such that this higher flow promotes better cooling of the upper bearing (56) to prolong its operating life; and the forced flow of oil through the lower shaft bearing (70) assembly provides a purging effect to prevent accumulation of contaminants in this area.

23 Claims, 3 Drawing Sheets

PULVERIZER AUXILIARY LUBRICATION SYSTEM

BACKGROUND OF THE INVENTION

This invention relates to apparatus for pulverizing, i.e., grinding, material, and more specifically to an auxiliary lubrication system that is particularly suited for use with a pulverizer bowl mill whereby the auxiliary lubrication system is operative to supplement the pulverizer bowl mill's existing lubrication system by supplying filtered oil to the main shaft bearings of the drive of the pulverizer bowl mill.

It has long been known in the prior art to provide apparatus employable for purposes of effecting the grinding of materials. More specifically, the prior art is replete with examples of various types of apparatus that have been used heretofore to effect the grinding of a multiplicity of different kinds of materials. In this regard, in many instances discernible differences of a structural nature can be found to exist between individual ones of the aforesaid apparatus. The existence of such differences is, in turn, attributable for the most part to the diverse functional requirements that are associated with the individual applications in which such apparatus are designed to be employed. For instance, in the selection of the particular type of apparatus that is to be utilized for a specific application, one of the principal factors to which consideration must be given is that of the nature of the material that is to be ground in the apparatus. Coal is one such material wherein there is a need to grind it in order to render it suitable for use in certain applications. Furthermore, fossil fuel fired power generation systems represent one such application in which it is desired to employ coal, as the source of fuel therefor, and wherein a requirement exists to grind, i.e., pulverize, the coal to render it suitable for use for this purpose, i.e., for use in a coal-fired power generation system.

For purposes of the discussion that follows, the coal-fired power generation systems referred to above are considered to consist of essentially the following major operating components: a coal feeder, apparatus for pulverizing coal, a distribution system for distributing the coal after the pulverization thereof, a furnace in which the coal is to be burned and the requisite controls for effecting the proper operation of the coal-fired power generation system. Of particular interest herein is that portion of the coal-fired power generation system which has been identified above as the apparatus for pulverizing the coal. Coal pulverizing apparatus are not new. They have been known to exist in the prior art for more than half a century. Furthermore, many improvements in the construction and/or mode of operation of coal pulverizing apparatus have been made during this period.

There are a number of features that it is advantageous for many coal pulverizing apparatus to possess, but particularly those which are designed for employment in a coal-fired power generation system. Reference is had here to features such as reliability, low power consumption, minimum maintenance and wide range of capacity. In addition, such apparatus advantageously should also be characterized by quiet operation, integrated lubrication systems, convenient adjustment and control of coal flow and fineness, and the ability to handle the high temperature air that is required for high moisture coal.

One particular type of coal pulverizing apparatus which is to be found in the prior art that is advantageously characterized by the embodiment therein of the above-recited features is an apparatus most commonly referred to in the industry by the name bowl mill. The latter apparatus obtains its name by virtue of the fact that the pulverization, i.e., grinding, of the coal which takes place therein is effected on a grinding surface that in configuration bears a resemblance to a bowl.

Reference may be had, by way of exemplification, to U.S. Pat. No. 3,465,971, the latter being assigned to the same assignee as the instant application, for a teaching of the nature of the construction and the mode of operation of a prior art form of bowl mill that is suitable for use in a coal-fired power generation system to effectuate the pulverization of the coal that is to be burned as fuel therein. As taught by the aforementioned patent, a bowl mill essentially consists of a body portion in which a grinding table is mounted for rotation, a plurality of grinding rollers that coact with the grinding table to effect the grinding of coal interposed therebetween, coal supply means for feeding to the interior of the bowl mill the coal that is to be pulverized, and air supply means for supplying to the interior of the bowl mill the air required in the operation of the latter. In accordance with the mode of operation of such a bowl mill, the coal, which enters the bowl mill, is pulverized by virtue of the coaction of the grinding rollers with the grinding table. After being pulverized, the coal particles are thrown outwardly by centrifugal force whereby the particles are fed into a stream of air that is entering the bowl mill. The stream of air, which now contains pulverized coal particles, flows through a tortuous path that is established in part by the positioning within the bowl mill of a suitably supported deflector means. As the stream of air and coal particles flows along the aforementioned tortuous path, the sharp turns contained therein effects the separation of the coarse coal particles from the air stream. These coarse coal particles are then suitably returned to the grinding table for further pulverization while the fine coal particles are carried through the bowl mill in the air stream, and exit therefrom along with the air.

In a conventional coal-fired power generation system, a multiplicity of bowl mills of the type shown in the aforementioned patent would commonly be employed for purposes of satisfying the requirements of the system for pulverized coal. By way of example, the capacity of each of the individual bowl mills might be on the order of one hundred tons per hour of coal.

Although bowl mills constructed in accordance with the teachings of the aforementioned patent have, under actual operating conditions, proven capable of providing adequate performance to date a need has nevertheless been evidenced for improvements to be made therein. More specifically, prolonged operation of this type of bowl mill has revealed the existence of several conditions of an undesirable nature that can arise during the use thereof. In particular, reference is had here to the fact that prior art forms of lubrication systems for pulverizing bowl mills are known to suffer, by way of exemplification and not limitation, from the following disadvantages. One of these is that such prior art forms of lubrication systems for pulverizing bowl mills embody no provision for filtering contaminants from the lube oil. Another is that such prior art forms of lubrication systems for pulverizing bowl mills embody no provision for high volume purging flow through the lower bearings of the pulverizing bowl mill wherein such high volume purging flow is designed to be operative to inhibit contamination accumulation in this area. A third is that in accord with the mode of operation of such prior art forms of lubrication systems for pulverizing bowl mills oil is pumped to the upper bearing of the pulverizing bowl mill only when the pulverizing bowl mill is operating. A fourth is that in accord with the mode of operation of such prior art forms of lubrication systems for pulverizing bowl mills oil volume flow is inherently limited by the nature of the pump design thereof to the extent that cooling rates recommended by the bearing manufacturer can not be satisfied therewith. A fifth is that when employed under certain conditions it takes considerable time for such prior art forms of lubrication systems for pulverizing bowl mills to confirm by means of the visual sight gauge the existence of upper bearing return oil flow in the pulverizing bowl mill, such confirmation being required before the material that is to be ground in the pulverizing bowl mill can be admitted to the pulverizing bowl mill. A need has, therefore, been evidenced in the prior art for a new and improved form of lubrication system suitable for use with a pulverizing bowl mill which by filtering out wear causing oil contaminants would enable bearing and gear life to be extended thereby eliminating costly premature replacement of these components, by providing the higher flow rate recommended by bearing manufacturers would reduce upper bearing operating temperature thereby extending bearing life, by continuously purging the lower bearing area within the pulverizing bowl mill would reduce the accumulation of contaminants in the aforesaid area thereby lessening the potential for premature thrust and lower radial bearing failures, by maintaining oil cleanliness would reduce lubricant replacement cost, by employing on-line filtration which is more effective would eliminate the labor costs associated with periodic cleanup using portable equipment, and by pumping oil to the upper bearing continuously, i.e., even when the pulverizing bowl mill is not operating, would enable the material that is to be ground in the pulverizing bowl mill to be admitted thereto immediately after the pulverizing bowl mill is started thereby obviating the need to wait the time which would otherwise be required in order to confirm by means of the visual sight gauge the existence of upper bearing return oil flow in the pulverizing bowl mill before admitting thereto the material that is to be ground therein. To thus summarize, a need has been evidenced in the prior art for such a new and improved lubrication system suitable for use with a pulverizing bowl mill which would be operative to enable an enhancement of the availability of the pulverizing bowl mill to be realized without necessitating additional operating requirements or restraints.

It is, therefore, an object of the present invention to provide a new and improved lubrication system suitable for use with a bowl mill of the type that is operative for effecting therewithin the pulverization of a material such as coal.

It is a further object of the present invention to provide such a lubrication system particularly suited for use with a bowl mill which is operative to supplement the bowl mill's existing lubrication system by supplying filtered oil to the main shaft bearings of the bowl mill.

It is another object of the present invention to provide such an auxiliary lubrication system particularly suited for use with a bowl mill which is characterized in that by filtering out wear causing oil contaminants bearing and gear life is extended such that costly premature replacement of these components can be eliminated.

It is still another object of the present invention to provide such an auxiliary lubrication system particularly suited for use with a bowl mill which is characterized in that by providing the higher flow rat recommended by bearing manufacturers the upper bearing operating temperature is reduced thereby enabling bearing life to be extended.

A further object of the present invention is to provide such an auxiliary lubrication system particularly suited of use with a bowl mill which is characterized in that by continuously purging the lower bearing area within the bowl mill accumulation of contaminants in this area is reduced thereby lessening the potential for premature thrust and lower radial bearing failures.

A still further object of the present invention is to provide such an auxiliary lubrication system particularly suited for use with a bowl mill which is characterized in that by maintaining oil cleanliness a reduction in lubricant replacement cost can be realized.

A still another object of the present invention is to provide such an auxiliary lubrication system particularly suited for use with a bowl mill which is characterized in that by pumping oil to the upper bearing continuously, i.e., even when the pulverizing bowl mill is not operating, enables the material that is to be ground in the pulverizing bowl mill to be admitted thereto immediately after the pulverizing bowl mill is started rather than having to wait until the existence of upper bearing oil flow in the pulverizing bowl mill is confirmed by means of the visual sight gauge before the material that is to be ground in the pulverizing bowl mill can be admitted thereto.

Yet a further object. of the present invention is to provide such an auxiliary lubrication system particularly suited for use with a bowl mill which is characterized in that by employing on-line filtration which is more effective the labor costs associated with periodic cleanup using portable equipment are eliminated.

Yet another object of the present invention is to provide such an auxiliary lubrication system particularly suited for use with a bowl mill which is designed for employment primarily in retrofit applications.

Yet still another object of the present invention is to provide such an auxiliary lubrication system particularly suited for use with a bowl mill which is advantageously characterized by its ease of manufacture and its ease of assembly in cooperative association with a bowl mill, as well as by the fact that it is relatively inexpensive to provide.

SUMMARY OF THE INVENTION

In accordance with the present invention there is provided a lubrication system which is particularly suited for use with a bowl mill and when so employed therewith is operative as an auxiliary lubrication system to supplement the bowl mill's existing lubrication system by supplying filtered oil to the main shaft bearings of the bowl mill. The subject auxiliary lubrication system includes an oil pump, an electric motor coupled to and operative for driving the oil pump, one or more of filters, a pressure relief valve,, connecting piping, gauges and controls, and means to supply oil to and to draw oil from the bowl mill with which the subject auxiliary lubrication system is being employed. The oil pump is connected in fluid flow relation by means of connecting piping to the lubricant reservoir of the bowl mill such that oil flows by gravity from the lubricant reservoir through the connecting piping to the oil pump. The motor is operatively connected to a temperature switch such as to be energized thereby causing the motor to operate whenever the oil within the lubricant reservoir of the bowl mill is sensed to be above a predetermined temperature. Upon being energized the motor is operative to drive the oil pump such as to cause oil to be withdrawn from the lubricant reservoir of the bowl mill and to be conveyed through a filter for purposes of removing contaminant particles therefrom. The pressure relief valve is operatively connected between the oil pump and the aforementioned filter through which the oil is made to pass after being withdrawn from the lubricant reservoir of the bowl mill such that the pressure relief valve is operative to limit the oil pump discharge pressure to a predetermined maximum level. The pressure relief valve in turn is connected in fluid flow relation by means of connecting piping to the lubricant reservoir of the bowl mill such that from the pressure relief valve the oil is made to flow back to the lubricant reservoir of the bowl mill through the connecting piping. With further reference to the aforementioned filter, the oil after leaving the filter is divided into two flow streams. To this end, by means of connecting piping through which the subject auxiliary lubrication system is interconnected to the bowl mill, one of these flow streams goes to the upper shaft bearing of the bowl mill and the other flow stream goes to the lower shaft bearing assembly of the bowl mill. Continuing, the connecting piping which serves to interconnect the subject auxiliary lubrication system to the bowl mill is provided with flow sight gauges, fixed meeting orifices and check valves. Within the bowl mill, the oil which is supplied to the bearings is collected in the lubricant reservoir of the bowl mill and thereafter flows back to the oil pump to complete the cycle. In this regard, the oil which is supplied to the upper bearing of the bowl mill drains into a collector ring, and then flows back to the lubricant reservoir of the bowl mill through an oil return connecting pipe and a flow sight gauge.

DESCRIPTION OF A PREFERRED EMBODIMENT

Figure 1:
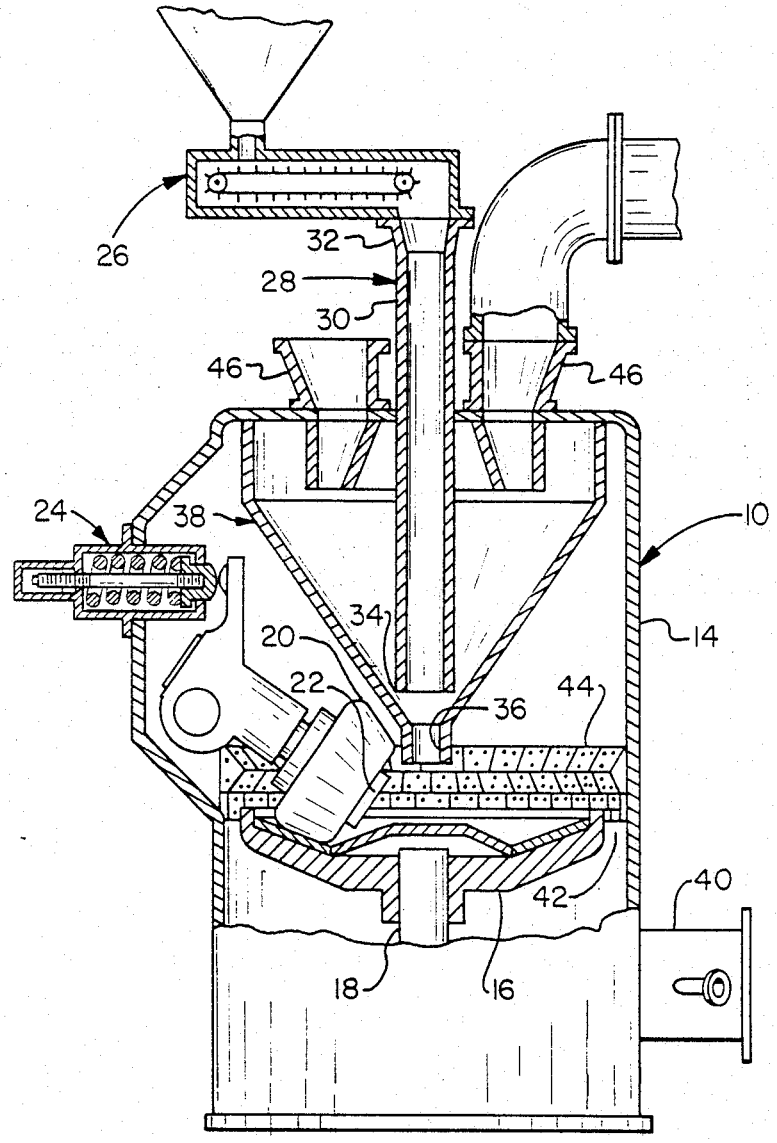
FIG. 1 is a side elevational view partially in section of a bowl mill with which an auxiliary lubrication system constructed in accordance with the present invention is designed to be employed.
Figure 2:
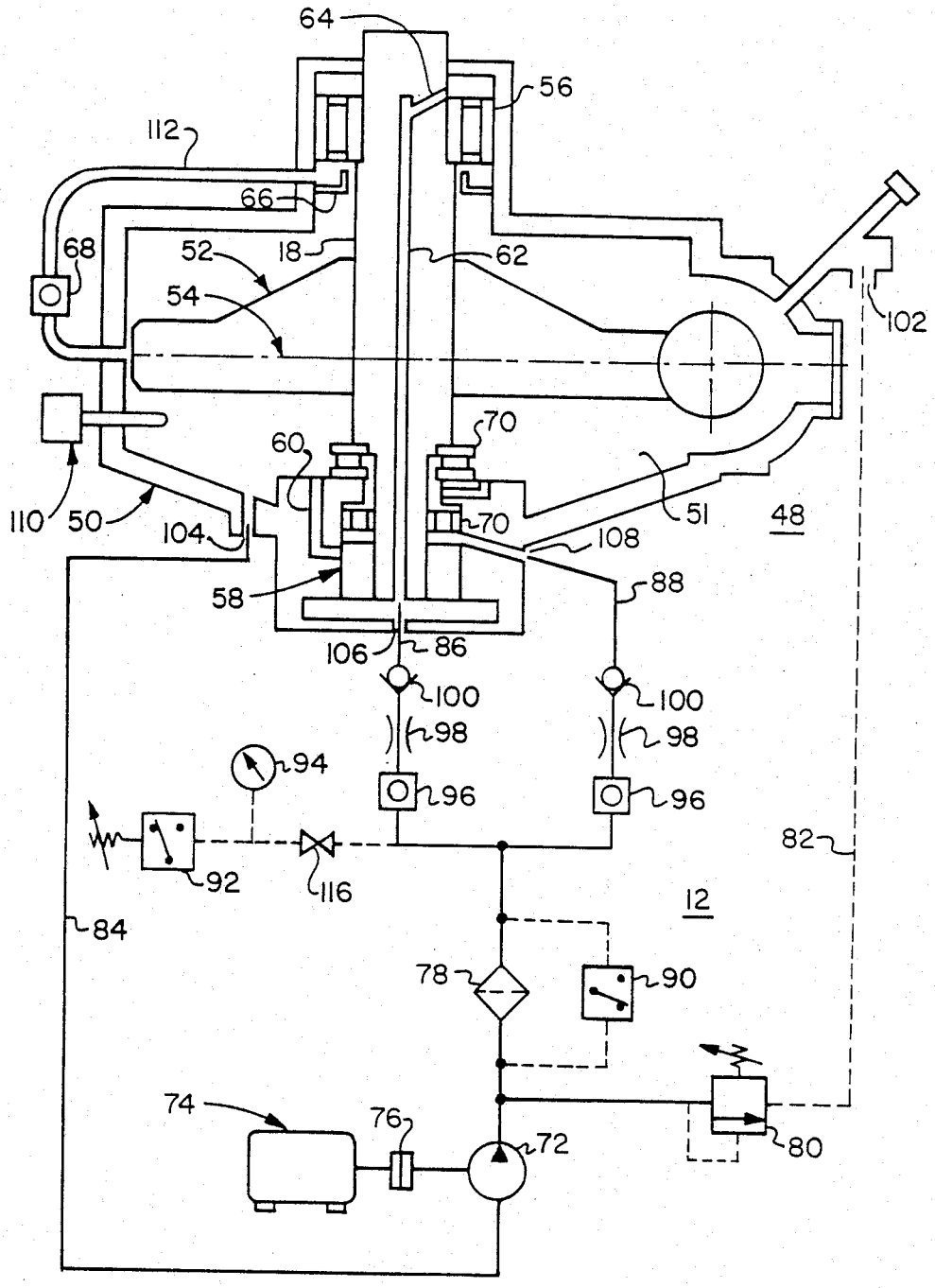
FIG. 2 is a schematic illustration of an auxiliary lubrication system for bowl mills constructed in accordance with the present invention depicted therein cooperatively associated with a bowl mill.

Referring now to the drawing, and more particularly to FIGS. 1 and 2 thereof, there is depicted therein a bowl mill, generally designated by reference numeral 10. Inasmuch as the nature of the construction and the mode of operation of bowl mills pe se are well-known to those skilled in the art, it is not deemed necessary, therefore, to set forth herein a detailed description of the bowl mill 10 illustrated in FIGS. 1 and 2. Rather, for purposes of obtaining an understanding of a bowl mill 10 with which an auxiliary lubrication system, generally designated by the reference numeral 12 in FIG. 2 of the drawing, constructed in accordance with the present invention is capable of being employed and when so employed therewith is operative as an auxiliary lubrication system to the existing lubrication system of the bowl mill 10 by supplying filtered oil to the main shaft bearings thereof, it is deemed sufficient that there be presented herein merely a description of the nature of the components of the bowl mill 10 with which the auxiliary lubrication system 12 cooperates. For a more detailed description of the nature of the construction and the mode of operation of the components of the bowl mill 10, which are not described in detail herein, one may have reference to the prior art, e.g., U.S. Pat. No. 3,465,971, which issued Sept. 9, 1969 to J. F. Dalenberg et al, and/or U.S. Pat. No. 4,002,299, which issued Jan. 11, 1977 to C. J. Skalka.

Referring further to FIG. 1 of the drawing, the bowl mill 10 as illustrated therein includes a substantially closed separator body 14. A grinding table 16 is mounted on a shaft 18, which in turn is operatively connected to a drive mechanism to which further reference will be had herein in more detail in connection with the description of tee nature of the construction and the mode of operation of the auxiliary lubrication system 12 of the present invention, so as to be capable of being rotatably driven thereby. With the afore referenced components arranged within the separator body 14 in the manner depicted in FIG. 1 of the drawing, the grinding table 16 is designed to be driven in a clockwise direction.

Continuing with a description of the bowl mill 10, a plurality of grinding, i.e., pulverizer, rolls 20, preferably three in number in accord with conventional practice, are suitably supported within the interior of the separator body 14 so as to be spaced equidistantly one from another around the circumference of the latter. Note is made here of the fact that in the interest of maintaining clarity of illustration in the drawing only one grinding roll 20 has been depicted in FIG. 1 of the drawing.

With further regard to the grinding rolls 20 of the bowl mill 10, each of the latter as best understood with reference to the grinding roll 20 depicted in FIG. 1 of the drawing i preferably supported on a suitable shaft, seen at 22 in FIG. 1, for rotation relative thereto. In addition, each of the grinding rolls 20, as best understood with reference to the grinding roll 20 of FIG. 1, is also suitably supported for movement relative to the upper surface, as viewed with reference to FIG. 1, of the grinding table 16. To this end, each of the grinding rolls 20 of the bowl mill 10 including the roll 20 illustrated in FIG. 1 has a spring means, generally designated in FIG. 1 by the reference numeral 24, cooperatively associated therewith. The spring means 24, in a manner well-known to those skilled in the art of bowl mills, is operative to establish a spring loading on the grinding roll 20 associated therewith whereby the latter grinding roll 20 is made to exert the requisite degree of force on the material, e.g., coal, that is disposed on the grinding table 16 for purposes of accomplishing the desired pulverization of this coal. One spring means, which is suitable for use as spring means 24 in the bowl mill 10 of FIG. 1 of the drawing, forms the subject matter of copending U.S. patent application Ser. No. 765,976 that was filed on Aug. 15, 1985 in the names of Robert S. Prairie and Frank J. Paskowski which issued on Nov. 17, 1987 as U.S. Pat. No. 4,706,900, and that is assigned to the same assignee as the present application.

The material, e.g., coal, that is to be pulverized in the bowl mill 10 is fed thereto by means of any suitable conventional form of feed means. By way of exemplification in this regard, one such feed means that may be employed for this purpose is a belt feeder means such as the belt feeder means which is depicted schematically in FIG. 1 of the drawing and wherein the belt feeder means is generally designated by the reference numeral 26. Upon being discharged from the belt feeder means 6, the coal enters the bowl mill 10 by means of a coal supply means, generally designated by reference numeral 28, with which the separator body 14 is suitably provided.

In accordance with the embodiment of the bowl mill 10 illustrated in FIG. I of the drawing, the coal supply means 8 includes a suitably dimensioned duct 30 having one end thereof which extends outwardly of the separator body 14 and which is suitably shaped as seen at 32 in FIG. 1 of the drawing so as to facilitate the collection of the coal particles leaving the belt feeder means 26, and the guiding thereafter of these coal particles into the duct 30. The other end 34 of the duct 30 of the coal supply means 28 is operative to effect the discharge of the coal on to the surface of the grinding table 16. To this end, as shown in FIG. 1 of the drawing, the duct end 34 preferably is suitably supported within the separator body 14 through the use of any suitable form of conventional support means (not shown) such that the duct end 34 is coaxially aligned with the shaft 18 that supports the grinding table 16 for rotation, and is located in spaced relation to a suitable outlet 36 provided in the classifier, generally designated by reference numeral 38, through which the coal flows in the course of being fed on to the surface of the grinding table 16.

In accord with the mode of operation of the bowl mills that embody the form of construction depicted in FIG. I of the drawing, a gas such as air is utilized to effect the conveyance of the coal from the grinding table 16 through the interior of the separator body 14 for discharge from the bowl mill 10. The air that is used in this regard enters the separator body 14 through a duct, denoted by the reference numeral 40 in FIG. 1 of the drawing, that is cooperatively associated with the bowl mill 10 so as to be usable for such a purpose. From the duct 40 the air flows into the separator body 14 and through the annulus, the latter being denoted in FIG. 1 by the reference numeral 42, which consists of the ring-like space that exists between the circumference of the grinding table 16 and the inner wall surface of the separator body 14. The air upon passing through the annulus 42 is deflected over the grinding table 16 preferably by means of a vane wheel assembly, constructed in accordance with the teachings of U.S. Pat. No. 4,523,721 which issued on June 18, 1985 to T. V. Maliszewski et al, and which is assigned to the same assignee as the present application. For purposes of maintaining clarity of illustration in the drawing only the deflector portion, the latter being seen at 44 in FIG. 1 of the drawing, of the vane wheel assembly which forms the subject matter of U.S. Pat. No. 4,523,721 has been depicted the drawing. Moreover, it is deemed that the depiction of the deflector portion 44 in FIG. 1 of the drawing is sufficient for purposes of enabling one to obtain a complete understanding of the subject matter of the present invention to which the instant application is directed. However, should further information be desired concerning the nature of the construction and/or the mode of operation of the vane wheel assembly that the bowl mill 10, which is shown in FIG. 1, embodies, reference may be had for this purpose to U.S. Pat. No. 4,523,721.

While the air is flowing along the path described above, the coal which is disposed on the surface of the grinding table 16 is being pulverized by the action of the grinding rolls 20. As the coal becomes pulverized, the particles are thrown outwardly by centrifugal force away from the center of the grinding table 16. Upon reaching the region of the circumference of the grinding table 16, the coal particles are picked up by the air exiting from the annulus 42 and are carried along therewith. The combined flow of air and coal particles is thereafter captured by the deflector portion 44 of the vane wheel assembly constructed in accordance with the teachings of U.S. Pat. No. 4,523,721. The effect of this is to cause the combined flow of this air and coal particles to be deflected over the grinding table 16. This necessitates a change in direction of the path of flow of this combined stream of air and coal particles. In the course of effecting this change of direction, the heaviest coal particles, because they have more inertia, become separated from the air stream, and fall back on to the surface of the grinding table 16 whereupon they undergo further pulverization. The lighter coal particles, on the other hand, because they have less inertia continue to be carried along in the air stream.

After leaving the influence of the aforesaid deflector portion 44 of the vane wheel assembly constructed in accordance with the teachings of U.S. Pat. No. 4,523,721, the combined stream consisting of air and those coal particles that remain flow to the classifier 38 to which mention has previously been had hereinbefore. The classifier 38, in accord with conventional practice and in a manner which is well-known to those skilled in this art, operates to effect a further sorting of the coal particles that remain in the air stream. Namely, those particles of pulverized coal, which are of the desired particle size, pass through the classifier 38 and along with the air are discharged therefrom and thereby from the bowl mill 10 through the outlets 46 with which the latter is provided for this purpose. On the other hand, those coal particles which in size are larger than desired are returned to the surface of the grinding table 6 whereupon they undergo further pulverization. Thereafter, these coal particles are subjected to a repeat of the process described above.

With further regard to the matter of the pulverizing, i.e., grinding, action to which the coal disposed on the grinding table 16 is subjected by the grinding rolls 20, the amount of force that must be exerted by the latter in order to effect the desired degree of pulverization of the coal will vary depending on a number of factors. For example, one important consideration in this regard is the nature of the coal itself. That is, the amount of force required to pulverize the coal will be a function of the griddability of the coal to be pulverized, i.e., the grinding characteristics of the latter. Another important factor in determining the amount of force that the grinding rolls 20 must exert to accomplish the desired degree of pulverization of the coal is the depth to which the coal is disposed on the grinding table 16, which in turn is a function of the output rate at which the bowl mill 10 is being operated.

Figure 3:
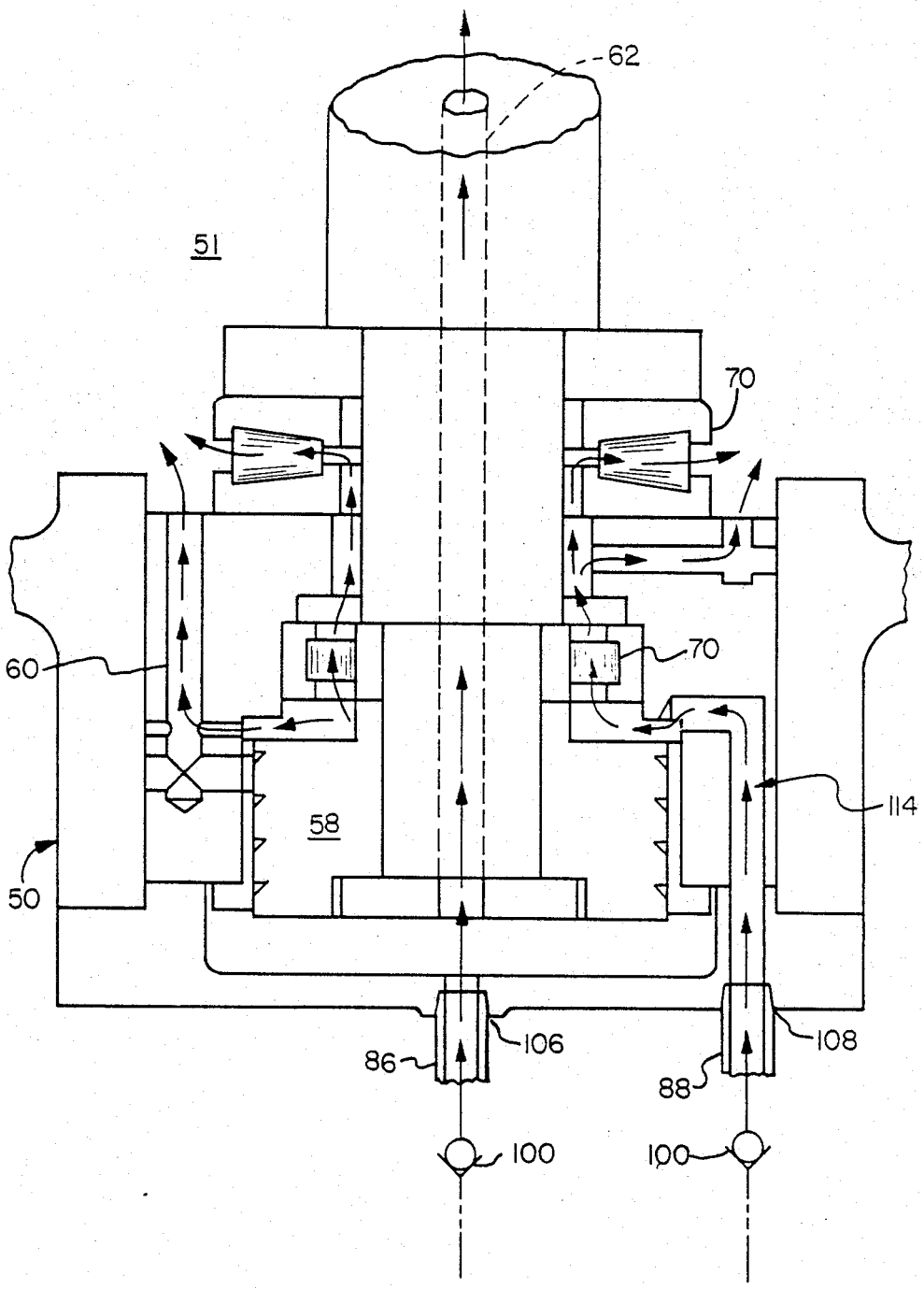
FIG. 3 is a schematic illustration of an auxiliary lubrication system for bowl mills constructed in accordance with the present invention depicting the flow path that the lubricant follows in accord with the mode of operation of the auxiliary lubrication system of the present invention.

Reference will now be had particularly to FIGS. 2 and 3 of the drawing for purposes of describing the nature of the construction and the mode of operation of the auxiliary lubrication system 12 which in accordance with the present invention is designed to be cooperatively associated with a bowl mill constructed in the manner of the bowl mill 10 that is depicted in FIG. 1 of the drawing. In order, however, for one to fully understand the nature of the construction and the mode of operation of the auxiliary lubrication system 12, which forms the subject matter of the present invention, one must also have a working knowledge of the existing lubrication system, the latter being denoted generally by the reference numeral 48 in FIG. 2 of the drawing, of the bowl mill 10. To this end, the bowl mill 10, as best understood with reference to FIG. 2 of the drawing, is suitably provided with a housing enclosure, generally denoted therein by the reference numeral 50, that is designed to function as the housing enclosure for the gear drive means, the latter being identified generally by the reference numeral 52 in FIG. 2, of the bowl mill 10. Apart from serving as an enclosure for the gear drive means 52 of the bowl mill 10, the housing enclosure 50 further functions as a lubricant reservoir, identified as 51 in FIG. 2, for the bowl mill 10. More specifically, the housing enclosure 50 is operative as a reservoir for lubricant, e.g., lube oil, within the bowl mill 10. In accord with the mode of operation of the existing lubrication system 48 of the bowl mill 10, the lube oil is maintained at a level, the latter being denoted by the dotted line identified by the reference numeral 54 in FIG. 2 of the drawing, sufficient to partially or wholly submerge al the gears and bearings of the gear drive means 52 of the bowl mill 10 therewithin except for the upper shaft bearing seen at 56 in FIG. 2 which is located above the level 54 of the lubricant, e.g., lube oil, in the reservoir 51 provided by the housing enclosure 50.

Continuing with the description of the existing lubrication system 48 of the bowl mill 10, in accord with the nature of the construction thereof there is provided a spiral groove pump, denoted generally in FIG. 2 by the reference numeral 58. In known fashion, the spiral groove pump 58 is mounted on and is driven by the main shaft 18 of the bowl mill 10, to which reference has previously been had herein in connection with the description of the nature of the construction of the bowl mill 10 that is depicted in FIG. 1 of the drawing. Moreover, as best understood with reference to FIG. 2 of the drawing, the spiral groove pump 58 is submerged in the lube oil which is present in the lubricant reservoir 51 provided by the housing enclosure 50. When the bowl mill 10 is operating, the spiral groove pump 58 draws lube oil from the lubricant reservoir 51 provided by the housing enclosure 50 through the hole shown at 60 in FIG. 2 of the drawing and pumps this lube oil up through a central hole, identified by the reference numeral 62 in FIG. 2, that is suitably formed for this purpose in the main shaft 18 of the bowl mill 10 to a point above the upper bearing 56 from which the lube oil flows outward of the main shaft 18 through a communicating hole seen at 64 in FIG. 2 that is cross-drilled in the main shaft 18 and spills over the upper bearing 56. The lube oil is then collected at the location below the upper bearing 56 identified by the reference numeral 66 in FIG. 2. More specifically, the lube oil drains at the location 66 into a collector ring, which for ease of reference in the drawing is also identified by the same reference numeral 66. Thereafter, the lube oil flows under the influence of gravity by means of an oil return connecting pipe, the latter being denoted by the reference numeral 112 in FIG. 2 of the drawing, to and through a visual flow sight gauge, the latter being denoted by the reference numeral 68 in FIG. 2 of the drawing, which is suitably positioned relative to the housing enclosure 50 so as to be located externally thereof, and then returns to the lubricant reservoir 51 provided by the housing enclosure 50. Completing the description of the existing lubrication system 48 of the bowl mill 10, lube oil is circulated at low flow through the lower bearings, each identified by the same reference numeral 70 in FIG. 2 of the drawing, due to the inherent pumping action of the bearings 70. It is important to point out here that the existing lubrication system 48 of the bowl mill 10 constructed as described hereinabove is disadvantageously characterized in a number of respects. Namely, there is no provision therein for filtering contaminants from the lube oil. Secondly, there is no provision therein for high volume purging flow of lube oil through the lower bearings 70 to inhibit contaminant accumulation in this area. Thirdly, lube oil is pumped to the upper bearing 56 only when the bowl mill 10 is operating. Fourthly, lube oil volume flow is inherently limited by the type of design that the spiral groove pump 58 embodies and, consequently, the pump 58 is unable to cool the bearing 56 at the rate recommended by the bearing manufacturers. Finally, under certain operating conditions, the existing lubrication system 48 of the bowl mill 10 may take considerable time to prove by means of the visual flow sight gauge 68 that there is return lube oil flow from the upper bearing 56. This is significant in that material cannot be admitted to the bowl mill 10 for grinding, i.e., pulverization, therein until it has been proven that there exists lube oil flow.

On the other hand, besides its inherent simplicity the existing lubrication system 48 does possess one advantage with regard to the matter of lube oil temperature. Reference is had here to the fact that the spiral groove pump 58 is more efficient with higher viscosity (colder) oil, although this is offset somewhat as the pump 58 wears. Minimum operating lube oil temperature though is not a strict requirement insofar as concerns initiating the start of the operation of the bowl mill 10. Moreover, the absence in the existing lubrication system 48 of the bowl mill 10 of components affected by viscosity which depends on lubricant, e.g., lube oil, temperature, eliminates the requirement to maintain a minimum operating temperature. However, at lower temperature, it takes longer for cold, viscous lube oil to pump up to the upper bearing 56 and thereafter to flow under the influence of gravity to and through the return flow visual flow sight gauge 68.

With the foregoing description of the existing lubrication system 48 of the bowl mill 10 by way of background, attention will next be focused on the auxiliary lubrication system 12, which forms the subject matter of the present invention and which is intended to function in conjunction with the existing lubrication system 48 rather than as a substitute therefor, i.e., rather than wholly supplanting the existing lubrication system 48. The fact that the auxiliary lubrication system 12 in accord with the present invention works in conjunction with the existing lubrication system 48 rather than wholly supplanting the latter is considered to be one of the unique and innovative features of the auxiliary lubrication system 12 of the present invention. To this end, as a result of following this approach one is able to eliminate the disadvantages associated with the employment of the existing lubrication system 48 while yet enabling the beneficial features of the existing lubrication system 48 to be retained. A further result of following this approach is that it enables a reduction to be realized in the material and installation costs that are associated with the employment of the auxiliary lubrication system 12 of the present invention.

Proceeding now with the description of the nature of the construction of the auxiliary lubrication system 12 of the present invention, as best understood with reference to FIGS. 2 and 3 of the drawing the auxiliary lubrication system 12 in accord with the best mode embodiment of the invention basically consists of the following components: an oil pump seen at 72 in FIG. 2 of the drawing, a motor denoted generally by the reference numeral 74 in FIG. 2 of the drawing which in accord with the best mode embodiment of the invention preferably takes the form of an electric motor and which is operatively coupled to the oil pump 72 through the coupling identified by the reference numeral 76 in FIG. 2 so as to be operative to drive the oil pump 72, at least one filter which is denoted by the reference numeral 78 in FIG. 2 of the drawing, a pressure relief valve seen at 80 in FIG. 2 of the drawing, connecting piping depicted at 82, 84, 86 and 88, respectively, in FIG. 2 of the drawing, gauges and controls that are identified by the reference numerals 90, 92, 94, 96, 98, 100, 110 and 116, respectively, in FIG. 2 of the drawing, and means shown at 102, 104, 106 and 108, respectively, in FIG. 2 of the drawing operative for supplying lube oil to and to draw lube oil from the bowl mill 10. Thus to summarize, the oil pump 72 and the other associated parts of the auxiliary lubrication system 12 are designed in accord with the best mode embodiment of the invention to be located in relatively close proximity to the bowl mill 10 and to be interconnected therewith by means of the connecting piping, i.e., the oil pipes 82, 84, 86 and 88, respectively, through which the lube oil is designed to be conveyed to and from the lubricant reservoir 51 provided by the housing enclosure 50 of the bowl mill 10 while the bowl mill 10 as discussed previously herein has as part of the existing lubrication system 48 its own shaft driven pump 58 and lubricant storage reservoir 51.

Continuing with the description of the auxiliary lubrication system 12 which comprises the subject matter of the present invention, in accordance with the mode of operation thereof lube oil flows under the influence of gravity through the connecting piping 84 from the lubricant reservoir 51 to the oil pump 72. Then, whenever the temperature of the lube oil in the lubricant reservoir 51 rises above a predetermined temperature a signal indicative of this occurrence is generated. More specifically, this signal is generated by the temperature switch denoted generally by the reference numeral 110 in FIG. 2 of the drawing, which is suitably mounted on the housing enclosure 50 so as to be operative to sense the temperature of the lube oil within the lubricant reservoir 51. Any conventional type of temperature switch suitable for use in the aforedescribed manner may be utilized as the temperature switch 110 in the auxiliary lubrication system 12 of the present invention. The temperature switch 110 is connected in circuit relation with the motor 74 such that when transmitted to the motor 74 the signal generated by the temperature switch 110 is operative to energize the motor 74. Thereupon, lube oil is drawn from the lubricant reservoir 51 by the motor driven oil pump 72 and is made to pass through the filter 78 during the course of which contaminant particles are removed from the lube oil by the filter 78. The pressure relief valve 80 which as best understood with reference to FIG. 2 of the drawing is positioned between the oil pump 72 and the filter 78, and which is connected in fluid flow relation therewith, is designed to be operative to limit the discharge pressure of the oil pump 72 to a prestablished maximum level. The lube oil from the pressure relief valve 80 flows back to the lubricant reservoir 51 through the connecting piping 82. Whereas, the lube oil leaving the filter 78 upon exiting therefrom is split into two flow streams. One of these flows to the upper shaft bearing 56 by means of the connecting piping 86 and the central hole 62 that is suitably provided for this purpose in the main shaft 18 of the bowl mill 10. The other flows to the lower shaft bearing assembly, i.e., the lower bearings 70, of the bowl mill 10 by means of the connecting piping denoted by the reference numeral 88 in FIG. 2 of the drawing. Thus, to summarize, both of these flows are conveyed from the auxiliary lubrication system 12 to respective portions of the bowl mill 10 by means of the connecting piping 86 and 88. With further reference to the connecting piping 86 and 88, the latter each have connected in fluid flow relation therewith a visual flow sight gauge 96, a fixed metering orifice 98 and a check valve 100. Finally, the lube oil which is supplied to the upper bearing 56 and the lower bearings 70 is collected within the bowl mill in lubricant reservoir 51 and as discussed previously herein flows under the influence of gravity from the lubricant reservoir 51 to the oil pump 72. To this end, as regards the lube oil which is supplied to the upper bearing 56, this lube oil drains into the collector ring 66 and then flows therefrom by means of an oil return connecting pipe, the latter being denoted by the reference numeral 112 in FIG. 2 of the drawing, to the visual flow sight gauge 68 and therethrough back to the lubricant reservoir 51. Numbered among the advantages that are derived from employing the auxiliary lubrication system 12 of the present invention with the bowl mill 10 are the following. First, the lube oil which is utilized for purposes of lubrication in the bowl mill 10 is filtered by means of the filter 78 of the auxiliary lubrication system 12 to remove contaminants therefrom that could have a deleterious impact insofar as the operating life of the bearings and gears of the bowl mill 10 are concerned. Secondly, the flow rate of the lube oil to the upper shaft bearing 56 is higher with the auxiliary lubrication system 12 than that attainable with the pump 58 which is an integral part of the existing lubrication system 48 of the bowl mill 10. To this end, by promoting better cooling of the upper shaft bearing 56 this higher flow rate operates to prolong the operating life of the upper bearing 56. Thirdly, the forced flow of oil under the influence of the oil pump 72 of the auxiliary lubrication system 12 through the lower shaft bearing assembly, i.e., the lower bearings 70, of the bowl mill 10 provides a purging effect so as to thereby prevent the accumulation of contaminants in this area.

With further regard to the auxiliary lubrication system 12, for purposes of economically sizing the viscosity affected components thereof there is a need in accordance with the nature of the construction of the auxiliary lubrication system 12 that the minimum temperature of the lubricant, e.g., the lube oil, in the lubricant reservoir 51 be above a preset value. In this connection, the temperature switch 110 is operative as discussed previously herein to sense the temperature of the lube oil within the lubricant reservoir 51. Purposely, the auxiliary lubrication system 12 in accord with the best mode embodiment of the invention is designed such that the operation of the auxiliary lubrication system 12 cannot be initiated until such time as the lube oil is at least at or above the afore referenced preset value, i.e., has reached at least a preestablished minimum temperature. However, since the existing lubrication system 48 of the bowl mill 10 and, more specifically, the pump 58 thereof is neither affected by this limitation as regards minimum temperature of the lube oil nor by any other similar limitation involving a requirement that the lube oil i the lubricant reservoir 51 be at a preset minimum temperature for purposes of initiating operation of the existing lubrication system 48 of the bowl mill 10, the operation of the bowl mill 10 is capable of being started and operated in the same manner as it has in the past.

Continuing, the hot process air that in accordance with known practice is employed to dry the coal which is to be subjected to grinding within the bowl mill 10 and also to convey, i.e., transport, the coal particles through the bowl mill 10 is operative further to warm the lube oil which is within the lubricant reservoir 51 up to the point where the lube oil is at the afore referenced preset temperature thereby enabling initiation of the operation of the auxiliary lubrication system 12 to be had. Thereafter, i.e., from that point on, the pump 72 of the auxiliary lubrication system 12 and thereby also the auxiliary lubrication system 12 itself will in accord with the best mode embodiment of the invention continue to operate as long as the temperature of the lube oil within the lubricant reservoir 51 remains at or above the afore referenced preset value. Should the temperature of the lube oil within the lubricant reservoir 51 fall below the afore referenced preset value, then the pump 72 of the auxiliary lubrication system 12 and thereby also the auxiliary lubrication system 12 will cease to operate. However, the pump 58 of the existing lubrication system 48 and thereby also the existing lubrication system 48 itself will continue to operate thus providing the bowl mill 10 with the minimum lubrication that it requires.

An important consideration insofar as the nature of the construction and the mode of operation of the auxiliary lubrication system 12 of the present invention is concerned is the method by which the lube oil supplied by the auxiliary lubrication system 12 to the lower bearing area, i.e., the area of the lower bearings 70, of the bowl mill 10 is admitted thereto. To this end, a lube oil passage hole, denoted generally by the reference numeral 114 in FIG. 3 of the drawing, is suitably provided preferably by drilling through the housing parts of the bowl mill 10 such that the lube oil being supplied by the auxiliary lubrication system 12 to the bowl mill 10 is admitted to the bowl mill 10 at a position which is located above the pump 58 of the existing lubrication system 48 and below the lower bearings 70 of the bowl mill 10 whereby the lube oil flows upwardly through the lower bearings 70 and in doing so is operative to effectuate a purging of contaminants from this area. This method of purging contaminants from the lower bearing assembly area, i.e., from the area of the lower bearings 70, of the bowl mill 10 is advantageously characterized by the fact that the normal operation of the pump 58 of the existing lubrication system 48 of the bowl mill 10 is not impaired thereby. Moreover, since the flow of the lube oil which is externally supplied, i.e., is supplied by the auxiliary lubrication system 12 of the present invention, to the bowl mill 10 is substantially higher than the flow of the lube oil which is supplied by the existing lubrication system 48 of the bowl mill 10, the contribution in this regard of the pump 58 of the existing lubrication system 48 is small. Namely, the pump 72 of the auxiliary lubrication system 12 vis-a-vis the pump 58 of the existing lubrication system 48 essentially "takes over", overwhelming the pump 58 of the existing lubrication system 48 and enabling there to be provided a circulating loop for the lube oil in which continuous filtration of contaminant particles therefrom is accomplished, a high volume cooling flow of lube oil to the upper bearing 56 of the bowl mill, and a high volume purging flow of lube oil through the lower bearings 70 of the bowl mill 10.

It should thus be readily apparent from the foregoing that in accord with the mode of operation thereof if the auxiliary lubrication system 1 of the present invention is shut down while the bowl mill 10 is in operation, the internal shaft pump 58 of the existing lubrication system 48 of the present invention reverts back to its original function of supplying lube oil to the upper shaft bearing 56 of the bowl mill 10 granted at a lower rate of flow, but still at a rate of flow which is adequate to meet the lubrication requirements of the bowl mill 10 when the latter is operating. Outward-flow of lube oil from the existing lubrication system 48 to the auxiliary lubrication system 12 is prevented by means of the check valves, each denoted by the same reference numeral 100 in each of FIGS. 2 and 3 of the drawing, to which reference has been had herein previously. In summary, therefore, it can be seen that with the addition of the auxiliary lubrication system 12 of the present invention to the existing lubrication system 48 of the bowl mill 10, the pump 58 of the existing lubrication system 48 functions as a "start-up" pump and as a "back up" pump. As such, additional benefits are derived from the employment of the auxiliary lubrication system 12 of the present invention in conjunction with the existing lubrication system 48 of the bowl mill 10. On the other hand, absolute reliability of the auxiliary lubrication system 12 is not a requirement insofar as the operation of the bowl mill 10 is concerned. The result, therefore, is that there is considerable latitude insofar as the following matters are concerned; namely, the capability to downsize or eliminate components that are affected or required when total dependence is had on a wholly separate external lubrication system, the capability to enable lubrication system maintenance or repair to be based on available opportunity rather than on immediate need, and the capability to permit the user thereof to start with a basic auxiliary lubrication system and to supplement this with betterment options at a later date.

Completing the description of the auxiliary lubrication system 12 of the present invention, the latter as previously noted herein embodies gauges and instruments which are designed to be employed for purposes of effecting the monitoring and the controlling of the operation of the auxiliary lubrication system 12. To this end, if the filter 78 becomes plugged, the differential pressure switch 90 senses the existence of such a condition and inoperative to generate an alarm signal indicating this fact. The pressure switch 92 and the pressure gauge 94 on the other hand monitor the pressure of the lube oil which is being supplied to the bowl mill 10.

Continuing, the temperature switch 110 as described herein previously is operative to sense the temperature of the lube oil in the lubricant reservoir 51 and when this temperature is deemed to be adequate permits the pump 72 of the auxiliary lubrication system 12 to be started The connecting piping, i.e., lube oil supply pipes, 86 and 88 are each provided with a flow sight gauge 96 that are designed to be operative t provide a visual indication of the lube oil flow to the upper shaft bearing 56 and the lower shaft bearings 70 thereby eliminating the necessity to prove return flow of the lube oil by means of the sight gauge 68. The fixed metering orifices 98, on the other hand, control the distribution of total lube oil flow in the connecting piping 86 and 88. Whereas, the check valves 100 as mentioned hereinbefore are operative to prevent the back flow of lube oil from the pump 58 of the existing lubrication system 48 when the auxiliary lubrication system 12 is not in operation. Finally, a shut off valve, denoted by the reference numeral 116 in FIG. 2 of the drawing, is provided for purposes of enabling the pressure switch 92 and the pressure gauge 94 to be isolated so that repair or replacement thereof can be had while the auxiliary lubrication system 12 is in operation.

Thus, in accordance with the present invention there has been provided a new and improved lubrication system suitable for use with a bowl mill of the type that is operative for effecting therewithin the pulverization of a material such as coal. Moreover, there is provided in accord with the present invention a lubrication system particularly suited for use with a bowl mill which is operative to supplement the bowl mill's existing lubrication system by supplying filtered oil to the main shaft bearings of the bowl mill. Also, in accordance with the present invention the subject auxiliary lubrication system which is particularly suited for use with a bowl mill is characterized in that by filtering out wear causing oil contaminants bearing and gear life is extended such that costly premature replacement of these components can be eliminated. Further, the subject auxiliary lubrication system of the present invention which is particularly suited for use with a bowl mill is characterized in that by providing the higher flow rate recommended by bearing manufacturers the upper bearing operating temperature is reduced thereby enabling bearing life to be extended. In addition, in accordance with the present invention the subject auxiliary lubrication system which is particularly suited for use with a bowl mill is characterized in that by continuously purging the lower bearing area within the bowl mill accumulation of contaminants in this area is reduced thereby lessening the potential for premature thrust and lower radial bearing failures. Furthermore, the subject auxiliary lubrication system of the present invention which is particularly suited for use with a bowl mill is characterized in that by maintaining oil cleanliness a reduction in lubricant replacement cost can be realized. Additionally, in accordance with the present invention, the subject auxiliary lubrication system which is particularly suited for use with a bowl mill is characterized in that by employing on-line filtration which is more effective the labor costs associated with periodic cleanup using portable equipment are eliminated. Penultimately, the subject auxiliary lubrication system of the present invention which is particularly suited for use with a bowl mill is designed for employment primarily in retrofit applications. Finally, in accordance with the present invention the subject auxiliary lubrication system which is particularly suited for use with a bowl mill is advantageously characterized by its ease of manufacture and its ease of assembly in cooperative association with a bowl mill, as well as by the fact that it is relatively inexpensive to provide.

While only one embodiment of our invention has been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. In a pulverizer having a lubricant reservoir, internal pump means, an upper shaft bearing and lower shaft bearings, the improvement of a lubrication system for supplying lubrication to the upper shaft bearing and the lower shaft bearings of the pulverizer, said lubrication system comprising:

a. external pump means;

b. first means connecting said external pump means in fluid flow relation to the lubricant reservoir for supplying lubricant from the lubricant reservoir to said external pump means;

c. motor means coupled to said external pump means so as to be operative to drive said external pump means;

d. sensing means mounted in juxtaposed relation to the lubricant reservoir so as to be operative to sense the temperature of the lubricant in the lubricant reservoir, said sensing means further being operative to generate a signal when the temperature of the lubricant in the lubricant reservoir reaches a preset value, said sensing means being connected in circuit relation with said motor means for transmitting the signal generated by said sensing means to said motor means such that when received by said motor means the signal generated by said sensing means is operative to energize said motor means to drive said external pump means for purposes of effecting the withdrawal of lubricant from the lubricant reservoir;

e. second means connecting said external pump means in fluid flow relation to the upper shaft bearing and to the lower shaft bearings of the pulverizer for supplying the lubricant withdrawn from the lubricant reservoir by said external pump means to the upper shaft bearing and to the lower shaft bearings of the pulverizer so as to provide lubrication thereto; and f. third means connecting the upper shaft bearing and the lower shaft bearings in fluid flow relation to the lubricant reservoir for returning the lubricant supplied by said external pump means to the upper shaft bearing and to the lower shaft bearings therefrom to the lubricant reservoir.

2. In a pulverizer, the improvement of a lubrication system as set forth in claim 1 wherein said external pump means comprises a lube oil pump.

3. In a pulverizer, the improvement of a lubrication system as set forth in claim 2 wherein said first means comprises connecting piping having one end thereof connected in fluid flow relation to the lubricant reservoir and the other end thereof connected in fluid flow relation to said external pump means.

4. In a pulverizer, the improvement of a lubrication system as set forth in claim 3 wherein said motor means comprises an electric motor.

5. In a pulverizer, the improvement of a lubrication system as set forth in claim 4 wherein said sensing means comprises a temperature switch.

6. In a pulverizer, the improvement of a lubrication system as set forth in claim 5 wherein said second means is further operative to divide the lubricant withdrawn from the lubricant reservoir by said external pump means into a first flow stream extending from said external pump means to the upper shaft bearing of the pulverizer and into a second flow stream extending from said external pump means to the lower shaft bearings of the pulverizer.

7. In a pulverizer, the improvement of a lubrication system as set forth in claim 6 wherein said first flow stream is provided by a first segment of connecting piping having one end thereof connected in fluid flow relation to said external pump means and the other end thereof connected in fluid flow relation to the upper shaft bearing of the pulverizer, and said second flow stream is provided by a second segment of connecting piping having one end thereof connected in fluid flow relation to said external pump means and the other end thereof connected in fluid flow relation to the lower shaft bearings of the pulverizer.

8. In a pulverizer, the improvement of a lubrication system as set forth in claim 7 wherein said third means includes a collector ring supported in juxtaposed relation to the upper shaft bearing of the pulverizer so that the lubricant supplied by said external pump means to the upper shaft bearing will drain thereinto, and a lubricant return connecting pipe having one end thereof connected in fluid flow relation to said collector ring and the other end thereof connected in fluid flow relation to the lubricant reservoir.

9. In a pulverizer, the improvement of a lubrication system as set forth in claim 8 further including a visual sight gauge connected in fluid flow relation with said lubricant return connecting pipe so as to be operative to provide a visual indication of the return flow of lubricant through said lubricant return connecting pipe.

10. In a pulverizer, the improvement of a lubrication system as set forth in claim 9 further including a filter connected in fluid flow relation between said external pump means and said second means so as to be operative to remove contaminant particles from the lubricant being supplied by said external pump means both to the upper shaft bearing and to the lower shaft bearings of the pulverizer.

11. In a pulverizer, the improvement of a lubrication system as set forth in claim 10 further including a differential pressure switch connected in circuit relation with said filter so as to be operative to sense when said filter becomes plugged and to generate an alarm signal when said differential pressure switch senses said filter to be plugged.

12. In a pulverizer, the improvement of a lubrication system as set forth in claim 11 further including a pressure relief valve connected in fluid flow relation with said external pump means so as to be operative to limit the discharge pressure of said external pump means to a preestablished maximum level.

13. In a pulverizer, the improvement of a lubrication system as set forth in claim 12 further including a pressure switch and a pressure gauge each connected in fluid flow relation with said second means so as to be operative to monitor the pressure of the lubricant being supplied by said external pump means to both the upper shaft bearing and the lower shaft bearings of the pulverizer.

14. In a pulverizer, the improvement of a lubrication system as set forth in claim 12 further including a shut-off valve connected in fluid flow relation with both said pressure switch and said pressure gauge so as to be operative to enable said pressure switch and said pressure gauge to each be isolated from the lubrication system for purposes of performing repairs thereon and for effecting replacement thereof.

15. In a pulverizer, the improvement of a lubrication system as set forth in claim 7 wherein said first segment of connecting piping and said second segment of connecting piping each have a flow sight gauge connected in fluid flow relation therewith operative to provide a visual indication of lubricant flow therethrough.

16. In a pulverizer, the improvement of a lubrication system as set forth in claim 15 wherein said first segment of connecting piping and said second segment of connecting piping each have a fixed metering orifice connected in fluid flow relation therewith operative to control the distribution of total lubricant flow therethrough.

17. In a pulverizer, the improvement of a lubrication system as set forth in claim 16 wherein said first segment of connecting piping and said second segment of connecting piping each have a check valve connected in fluid flow relation therewith operative to prevent lubricant from flowing back through said first segment of connecting piping and said second segment of connecting piping from the internal pump means of the pulverizer when the lubrication system is not in operation.

18. A method for providing lubrication to a pulverizer through which hot transfer fluid flows and which includes an internal pump, an upper shaft bearing and lower shaft bearings, said method comprising the steps of:

a. providing within the pulverizer a reservoir of lubricant;
b. supplying upon start-up of the pulverizer lubricant from the reservoir of lubricant to the upper shaft bearing and to the lower shaft bearings of the pulverizer by means of the internal pump;
c. effectuating a heating of the lubricant contained in the reservoir of lubricant within the pulverizer by means of the hot transport fluid that flows through the pulverizer;
d. providing a temperature sensing device for sensing the temperature of the lubricant within the reservoir of lubricant;
e. generating a signal when the temperature of the lubricant contained in the reservoir of lubricant within the pulverizer sensed by the temperature sensing device reaches a predetermined value;
f. providing a motor driven external pump for withdrawing lubricant from the reservoir of lubricant;
g. employing the signal generated when the temperature of the lubricant contained in the reservoir of lubricant within the pulverizer sensed by the temperature sensing device reaches a predetermined value for purposes of initiating the operation of the motor driven external pump so as to cause the motor driven external pump to commence the withdrawal of lubricant from the reservoir of lubricant;

h. supplying the lubricant withdrawn from the reservoir of lubricant by means of the motor driven external pump to the upper shaft bearing and the lower shaft bearings of the pulverizer for purposes of providing lubrication thereto; and i. effectuating the return to the reservoir of lubricant within the pulverizer of the lubricant supplied by the motor driven external pump to the upper shaft bearing and the lower shaft bearings of the pulverizer.

19. The method as set forth in claim 18 further comprising the step of supplying the lubricant from the reservoir of lubricant within the pulverizer to the upper shaft bearing and the lower shaft bearings of the pulverizer by means of the motor driven external pump at a significantly greater rate of flow than the rate of flow at which lubricant is supplied by the internal pump to the upper shaft bearing and the lower shaft bearings of the pulverizer such that the motor driven external pump effectively takes over from the internal pump the function of providing lubrication to the upper shaft bearing and the lower shaft bearings of the pulverizer.

20. The method as set forth in claim 19 further comprising the step of filtering the lubricant withdrawn from the reservoir of lubricant by the motor driven external pump for purposes of removing contaminants from the lubricant.

21. The method as set forth in claim 20 further comprising the step of supplying by means of the motor driven external pump from the reservoir of lubricant to the upper shaft bearing of the pulverizer a high volume flow of lubricant sufficient to effectuate a cooling of the upper shaft bearing of the pulverizer.

22. The method as set forth in claim 21 further comprising the step of supplying by means of the motor driven external pump from the reservoir of lubricant to the lower shaft bearings of the pulverizer a high volume flow of lubricant sufficient to provide a purging effect to prevent contaminants from accumulating in the area of the lower shaft bearings of the pulverizer.

23. The method as set forth in claim 22 further comprising the step of admitting the lubricant being supplied by the motor driven eternal pump to the pulverizer at such a location in the pulverizer that the operation of the internal pump is unimpaired by the admission of the lubricant that is being supplied to the pulverizer by the external pump.

* * * * *